United States Patent [19]

Fujioka et al.

[11] 4,040,240

[45] Aug. 9, 1977

[54] METHOD AND APPARATUS FOR DOUBLING AND TWISTING A YARN BY A TWO-STEP CHANGEOVER SYSTEM

[75] Inventors: Kotaro Fujioka, Nagoya; Osami Tsuchihashi, Okazaki; Tetsuhiko Endo, Kyoto; Masakazu Hirota, Shiga, all of Japan

[73] Assignee: Toray Industries, Inc., Tokyo, Japan

[21] Appl. No.: 713,851

[22] Filed: Aug. 12, 1976

[30] Foreign Application Priority Data

Oct. 8, 1975 Japan ..... 50-120578

[51] Int. Cl.[2] ..... D01H 1/08

[52] U.S. Cl. ..... 57/34 CP; 57/76; 57/90; 57/156

[58] Field of Search ..... 57/34 CP, 34 R, 76, 57/77, 90, 156

[56] References Cited

U.S. PATENT DOCUMENTS

| | | | |
|---|---|---|---|
| 3,111,804 | 11/1963 | Beyer | 57/76 |
| 3,430,428 | 3/1969 | Asami et al. | 57/34 CP |
| 3,475,891 | 11/1969 | Matsuoka et al. | 57/34 CP |
| 3,834,150 | 9/1974 | Ottewell et al. | 57/156 |

FOREIGN PATENT DOCUMENTS

| | | | |
|---|---|---|---|
| 11,182 | 5/1969 | Japan | 57/34 CP |
| 85,832 | 2/1973 | Japan | 57/34 CP |

*Primary Examiner*—John Petrakes
*Attorney, Agent, or Firm*—J. Harold Nissen

[57] ABSTRACT

A method and apparatus for doubling and twisting a material yarn by a two-step changeover system by utilizing a pot twisting and winding device is disclosed. To produce a doubled and twisted yarn having a yarn configuration of two component yarns forming the yarn in a balanced condition, when the second step operation is carried out so as to double a primary twisted yarn of a yarn package formed in the pot by a first step operation with a yarn fed from a supply source and twist this doubled yarn while eliminating the primary twists imparted to the material yarn, the position of the bottom end of the traverse tube in the pot must be controlled so as to satisfy a particular condition $D_2 \geqq L_2$, where $D_2$ represents an inside diameter of the full size yarn package formed in the pot by the first step operation, while $L_2$ represents a distance between the bottom end of the traverse tube and an inside bottom surface of the pot.

21 Claims, 22 Drawing Figures

LENGTH DIFFERENCE BETWEEN YARNS (2) AND (2a) SEPARATED FROM THE PIECES OF YARN (12) WHICH WERE CUT IN 250 mm LENGTH

METHOD AND APPARATUS FOR DOUBLING AND TWISTING A YARN BY A TWO-STEP CHANGEOVER SYSTEM

The present invention relates to a method and apparatus for doubling and twisting a material yarn such as filamentary yarn and spun yarn by a two-step changeover system. More particularly, the invention relates to an improved doubling and twisting method and apparatus in which a yarn package of a primary twisted yarn is formed in a rotary pot, the primary twisted yarn is taken out from the rotary pot together with a yarn fed from a yarn feed device into the rotary pot, both the yarns are doubled and the doubled yarn is twisted while eliminating the primary twists imparted to the primary twisted yarn, and the resulting doubled and twisted yarn is taken up by a take-up device so as to form a yarn package.

A method in which a yarn or multifilament yarn fed continuously for formation of a primary twisted yarn is deposited in a pot while it is being twisted is known in the art. Further, Japanese Patent Publication No. 11182/69 and Japanese Patent Application Laid-Open Specification No. 85832/73 propose a method in which a primary twisted yarn package formed in such pot is retained in the pot without doffing, the primary twisted yarn is then taken out and twisted together with a yarn fed from a yarn feed device into the pot and the resulting doubled and twisted yarn is taken up by a take-up device. According to this method, a doubled and twisted yarn is produced by conducting alternately and repeatedly the first step of retaining temporarily a yarn fed from the yarn feed device in the rotary pot in the twisted state and the second step of taking out the primary twisted yarn retained in the rotary pot together with a yarn fed from the yarn feed device into the pot, and doubling and twisting both the yarns while eliminating the primary twists imparted to the yarn during the first step operation.

Changeover of the above described two steps has heretofore been performed manually under inspection of an operator. However, this manual operation is defective in that either the operational efficiency or the production yield is low, although it requires a great deal of labor.

In the above-mentioned method for doubling and twisting yarns, the operation is carried out by a two step changeover system comprising a first step operation wherein a spun yarn or a multi-filament yarn (hereinafter referred to as a yarn) is supplied into a pot by means of a traverse tube which traverses the yarn along an axial line of the pot so as to change the winding position inside the pot while imparting a first twist on the yarn, and; a second step operation wherein, when a predetermined length of the yarn is wound on the inside wall of the pot, the primary twisted yarn wound on the inside wall of the pot is doubled and twisted with the yarn continuously supplied through the traverse tube in the pot, and the doubled-twisted yarn is taken out from the pot along a direction coinciding with the axial center of the pot by means of a take-up device. The above-mentioned first and second step operations are conducted alternately and continuously in the two step changeover system. According to the inventors' experience, in the above-mentioned two step changeover system for producing the doubled and twisted yarn, it is a very delicate operation to control the balanced condition between the yarn tension of the primary twisted yarn produced in the first step operation and the yarn tension of the yarn supplied through the traverse tube during the second step operation. If such balanced condition is broken, either the primary twisted yarn or the yarn supplied through the traverse tube is wrapped on the other yarn, and such configuration of twisted doubled yarn is not suitable for practical use. Further, if the above-mentioned balanced condition is broken, there is the possibility that a group of entangled primary twisted yarns will be separated from the inside wall portion of the yarn package formed by the first step operation and doubled with the yarn supplied through the traverse tube, so that a defective yarn will be produced in the second step operation. During research conducted by the inventors, it was found that the above-mentioned problem is more serious in the case where the size of the inside diameter of the rotary pot is less than the size of the axial length of the rotary pot.

Consequently, it is the primary object of the present invention to provide a practical method and apparatus by which the above-mentioned problems or drawbacks of the two step changeover system for producing the doubled and twisted yarn by utilizing the rotary pot are completely solved or eliminated.

To attain the above-mentioned purpose of the present invention, in the method for doubling and twisting yarns by the two step changeover system according to the present invention, during the second step operation, it is essential to prescribe the length of the free path of the yarn supplied from the bottom of the traverse tube to the meeting position with the primary twisted yarn from the yarn package which meeting position is located near the hollow cylindrical aperture wall on the bottom inside surface of the rotary pot so that said length satisfies the relation of $D_2 \geqq L_2$, where $D_2$ represents the innermost diameter of the yarn package formed in the rotary pot by the first step operation, and $L_2$ represents a distance between the bottom end of the traverse tube and the bottom inside face of the rotary pot. The above-mentioned particular position may be changed within a location where the condition $D_2 \geqq L_2$ can be satisfied.

In order to practically carry out the above-mentioned method of the present invention, the apparatus of the present invention is provided with means for controlling the position of the traverse guide in such a manner that the position of the bottom end of the traverse guide satisfies the above-mentioned condition $D_2 \geqq L_2$.

To carry out the two step changeover system for producing doubled and twisted yarn according to the present invention with a high operational working efficiency, the termination of the second step operation is preferably detected by measuring the change in physical condition of the doubled and twisted yarn delivered from the rotating pot, and the single yarn which follows the doubled and twisted yarn is cut upon detection of a sudden change of the physical condition of said doubled and twisted yarn. When the single yarn which follows the doubled and twisted yarn is cut, its end portion buckles slightly with continued feed and touches the rotary pot, whereupon it is swung around by the centrifugal force on the cut-end portion of the yarn, the yarn end being withdrawn and pressed against the inside cylindrical surface of the rotating pot. Accordingly, yarn subsequently supplied by way of the traverse tube is automatically wound in the pot while it is being twisted.

To carry out the above-mentioned detecting operation, means for measuring a physical condition, such as yarn tension or thickness of yarn, is disposed at a position adjacent to the yarn passage between the rotary pot and the take-up device of the apparatus according to the present invention.

In order to practically carry out the above-mentioned method of the present invention, the apparatus of the present invention, preferably, further comprises means for detecting the completion of the first step operation and various auxiliary means, for example, means for adjusting the peripheral speeds of feed and take-up rollers, which are structural elements, and means for correcting an abnormal winding on the traverse tube during the operation.

BRIEF EXPLANATION OF THE ACCOMPANYING DRAWINGS

DETAILED EXPLANATION OF THE INVENTION

For the sake of an easy understanding of the present invention, the structure, function and effect of the doubling and twisting apparatus according to the present invention is firstly explained in detail with reference to an embodiment shown in FIGS. 1, 2 and 3.

Figure 1:
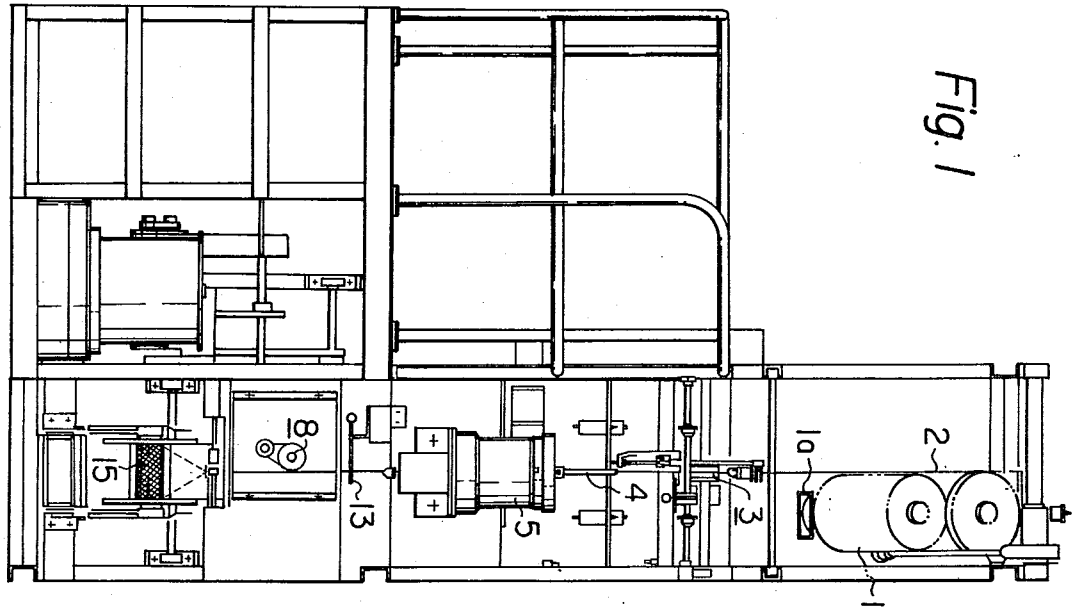
FIG. 1 is a front view of an apparatus for doubling and twisting yarns by a two step changeover system according to the present invention.
Figure 2:
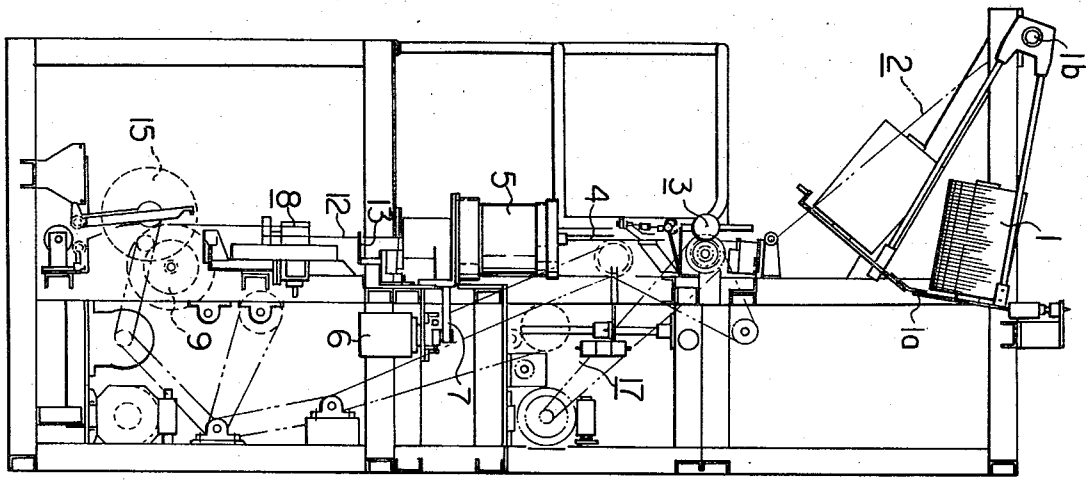
FIG. 2 is a side view of the doubling and twisting apparatus shown in FIG. 1.
Figure 3:
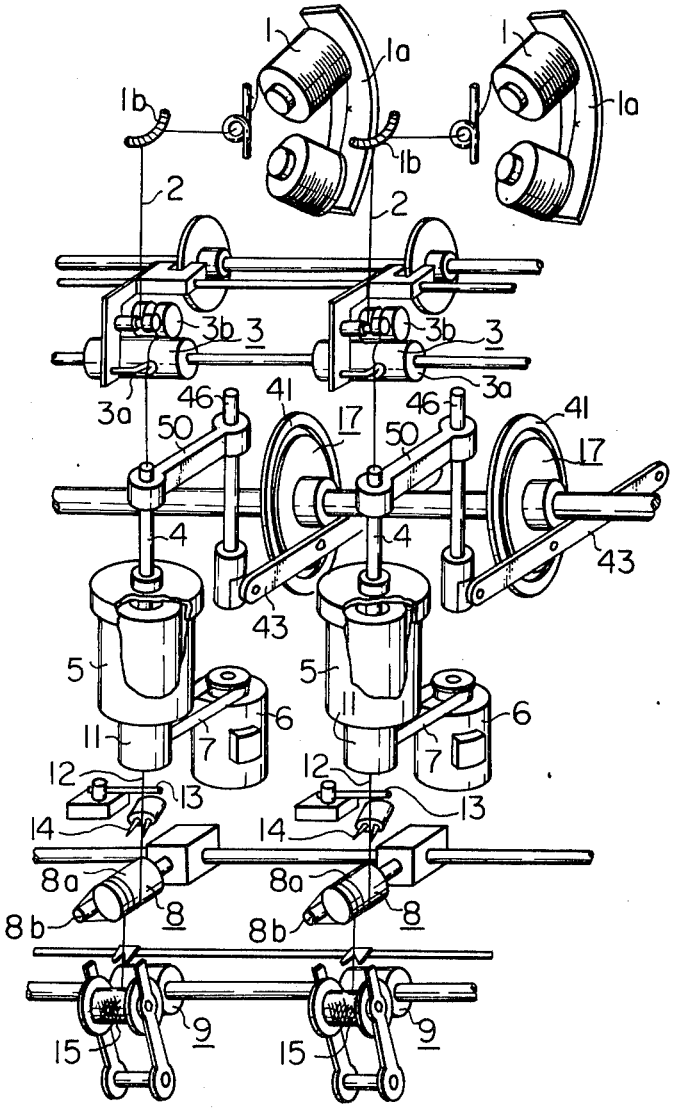
FIG. 3 is a perspective view of the doubling and twisting apparatus shown in FIG. 1.

As shown in FIGS. 1, 2 and 3, the apparatus of this embodiment comprises a creel 1*a* for holding a yarn package 1 of a material yarn 2, a yarn guide 1*b*, a feed mechanism 3 for supplying the material yarn 2 to a doubling and twisting mechanism, a rotary pot 5 disposed just below the feed mechanism 3 for twisting and winding the material yarn 2, take-up means 8 disposed just below the pot 5 a winding mechanism 9 for forming a yarn package 15 of a doubled and twisted yarn 12 delivered from the pot 5, means for detecting completion of the second step, such as a feeler 13, and a mechanism 14 for cutting a doubled and twisted yarn. The above-mentioned detecting means and cutting mechanism are disposed along a yarn passage between the pot 5 and take-up means 8. The pot 5 is rotatably supportd by a bearing 11 and driven by a motor 6 through a belt 7, a traverse tube 4 for making a vertical traverse movement along the rotation axis of the pot 5 and a traverse mechanism 17 for imparting the prescribed vertical traverse movement to the traverse tube 4.

Figure 4:
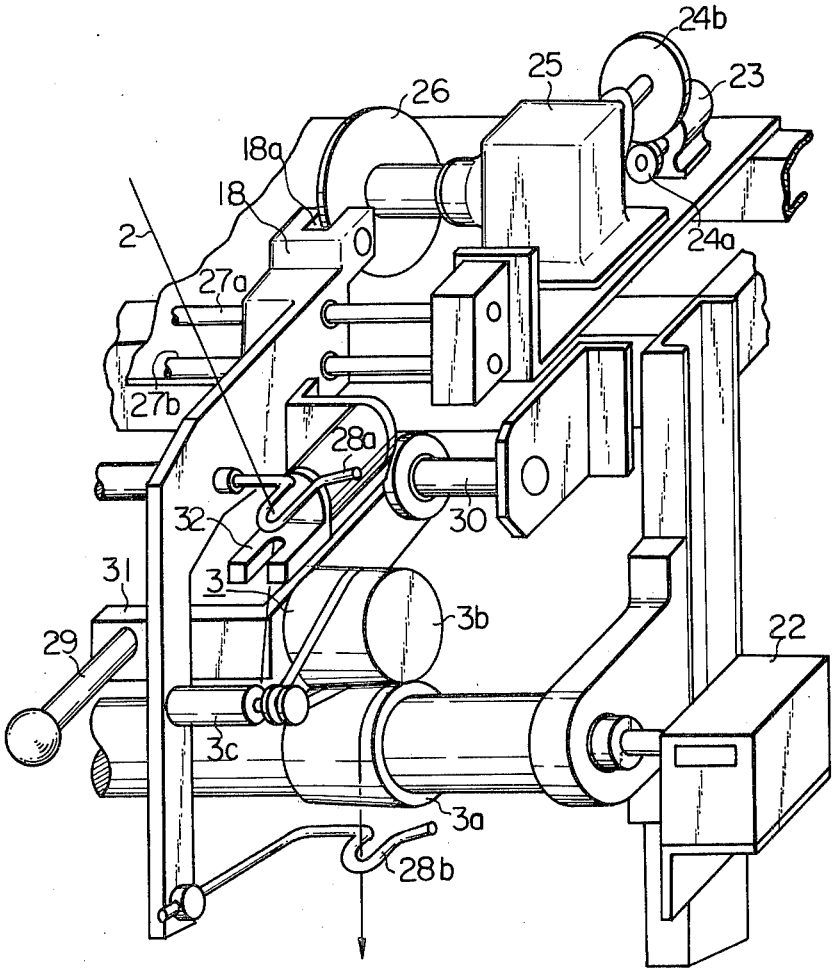
FIG. 4 is a detailed perspective view of a yarn feeding part of the apparatus shown in FIG. 3.

The feed mechanism 3 is arranged in such a condition that the feed rate of the yarn 2 is adjusted so as to correspond to the increasing rate of the size of yarn package, that is, the thickness of the yarn layer in the pot 5. As shown in FIG. 4, the feed mechanism 3 comprises a slightly tapered feed roller 3*a* and a slightly tapered nip roller 3*b*, which is urged against the feed roller 3*a* so as to be driven by frictional contact with the roller 3*a*, and a separate guide 3*c* disposed at a position adjacent to the roller 3*b* in parallel condition to the rotation axis of the roller 3*b*. The yarn 2 fed to the feed mechanism 3 passes therethrough in such a condition that the yarn 2 firstly passes around a part of the first guide groove formed on the guide 3*c* and then passes around a part of the nip roller 3*b*; thereafter, the yarn passes around a part of a second guide groove adjacent to the first guide groove formed on the guide 3*c* and, then, passes around a part of the nip roller 3*b* at a position adjacent to the upstream yarn passage thereon. After that, the yarn 2 is introduced into the traverse tube 4. If it is necessary to further pass the yarn 2 around part of the nip roller 3*b*, third, fourth . . . grooves must be formed in the guide 3*c* so as to further guide the yarn 2 to the nip roller 3*b*. When the yarn 2 passes around part of the nip roller 3*b*, since the nip roller 3*b* is urged against the tapered feed roller 3*a* so as to form a nip line between these two tapered rollers 3*a* and 3*b*, the yarn 2 is stably nipped by means of these two tapered rollers 3*a* and 3*b*. The guide 3*c* is horizontally supported by a sliding bracket 18 which is capable of displacing along a direction parallel to the axial direction of the tapered roller 3*b* from a position where the diameter of the roller 3b is smaller to a position where the diameter of the roller 3b is larger.

The number of rotations of the feed roller 3b is counted by a counter 22, and when a prescribed count number is reached, the counter 22 emits a pulse signal and a rotary selector 23 is turned by one step in response to this pulse signal. The counter 22 is automatically reset and the above-mentioned stepwise turning motion of the shaft of the rotary selector is continued. Although 7 to 8 hours are required for completion of one cycle of the operation, the displacing distance of the sliding bracket 18 is adjusted to about 20 mm and, hence, the displacing speed of the bracket 18 is very low. Accordingly, one-step motion of the rotary selector 23 is performed by turning an inclined cam plate 26 little by way of a gear train 24a, 24b and a gear box 25. Since a recess 18a on the top end of a sliding bracket 18 slidably mounted on a pair of guide rods 27a and 27b is engaged with the inclined cam plate 26, the bracket 18 is moved along the guide rods 27a and 27b by rotation of the inclined cam plate 26 and the yarn 2 is traversed by guides 28a and 28b attached to the bracket 18 and the separate guide 3c. When the yarn 2 is threading through the feed mechanism 3, a handle 29 of a bracket 31 attached to the nip roller 3b is lifted up about a fixed shaft 30 which works as a fulcrum. When abnormal winding takes places, a cutter 32 disposed just below the guide 28a is operated to cut the yarn 2, as detailed hereinafter.

A conventional electric counter and an automatic yarn cutter such as the counter and cutter utilized for the universal draw-textured machine manufactured by Heberlein Co., (Type FZ 42/11) may be used as the above-mentioned counter and yarn cutter with a little modification thereof.

Figure 5A:
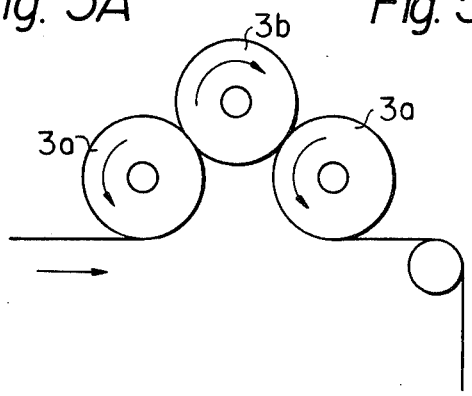
FIGS. 5A and 5B are schematic side views of other embodiments of the feeding mechanism which can be applicable to the apparatus shown in FIG. 1.
Figure 5B:
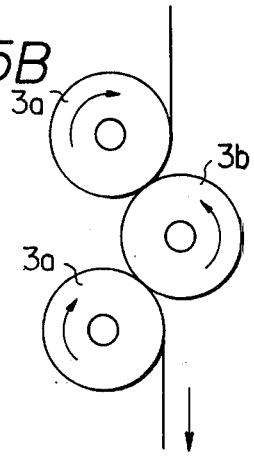

In order to nip the material yarn firmly and feed it to the pot-type doubling and twisting mechanism in stable condition, in addition to the two-line nip system as shown in the foregoing embodiment, there may be adopted a three-line nip system as shown in FIGS. 5A and 5B. In each case, it is preferredd that the yarn passes around a part of the peripheral face of the nip roller 3b driven by the non-compressible driving roller 3a with an angle of at least 90° to the axis of the nip roller 3b.

As pointed out hereinbefore, in the process of producing a doubled and twisted yarn by the apparatus of the above-mentioned embodiment, in the first step operation, the yarn 2 is passed through the traverse tube 4, which is provided with a traverse motion along the axial center line of the pot 5, and type yarn 2 is wound on a hollow portion 5a of the rotary pot 5 to form a yarn package 10 of a primary twisted yarn 2a. When a predetermined length of the primary twisted yarn 2a is wound on the inside wall of the pot 5, the traverse tube 4 stops the traverse movement, and a part of the yarn 2 running between the bottom end 4a of the traverse tube 4 and the inermost layer of the yarn package 10, formed on the inside wall of the pot 5, is gripped by a yarn holding member inserted from a yarn take-out aperture 5b and taken out from the pot 5. As a result, the yarn 2 continuously fed through the traverse tube 4 and the primary twisted yarn 2a wound on the inside wall of the pot 5 are doubled and twisted near the bottom inside surface 5c of the pot 5. In the above-mentioned doubling and twisting operation, the primary twists imparted to the material yarn 2 during the first step operation is eliminated, because of unwinding the primary twisted yarn 2a from the yarn package 10 during the second step operation. The doubled and twisted yarn 12 thus produced is introduced into the winding mechanism 9 by way of the take-up mechanism 8. The pot 5 is driven and rotated by the driving belt 7 in the same direction during both the first and second steps. It is preferable that the pot 5 be provided with such a shape that a relation of $D_1 \leqq L_1$ is established between the inside diameter ($D_1$) of the space 5a and the axial length ($L_1$) of space 5a. If this requirement is not satisfied, the rotation energy required for forming a full size package of the yarn 2a is excessively increased, resulting in a great loss of energy.

In order to find a practical condition for carrying out the doubling and twisting operation by means of the apparatus according to the present invention, experimental tests were repeated, as explained in detail in the example hereinafter presented. From the tests it was found that, if the condition of $D_2 \geqq L_2$, where $D_2$ represents the innermost wound diameter of the yarn package 10 formed in the rotary pot 5 by the first step operation, while $L_2$ represents a distance between the bottom end 4a of the traverse tube 4 and the bottom inside face 5c of the rotary pot 5 which distance is nearly equal to the free path length of the supplied yarn in the pot, is not satisfied in the apparatus when the second step operation is carried out, a yarn 12 having a homogeneous configuration can not be produced. This is because the ballooning phenomenon of the free path of the supplied yarn in the pot grows so remarkable that it goes by way of the surface of the yarn package in the pot and the balanced condition between two yarns is lost and cannot recover at all. In the case where the rotary pot 5 which satisfies the condition $D_1 \leqq L_1$ is utilized, the above-mentioned requirement of the condition $D_2 \geqq L_2$ becomes particularly important.

EXPERIMENT 1

Doubled and twisted yarn was prepared by using a rotary pot in which the relation of $L_1 \geqq D_1$ was established between the axial length ($L_1$) and the diameter ($D_1$) of the space 5a, while the relation between the innermost wound diameter ($D_2$) of the yarn package 10 formed in the pot 5 and the length ($L_2$) between the bottom end 4a of the traverse tube 4 and the bottom inside surface 5c of the pot 5 was changed as indicated in Table 1. The configuration of the resulting doubled and twisted yarn was examined. The length ($L_1$) and the diameter ($D_1$) were 222 mm and 140 mm, respectively, and the weight of the yarn package 10 formed in the pot 5 was 0.92 kg.

Table 1

| | $L_2$ (mm) | $D_2$ (mm) | Rotation No. (rpm) of Pot (5) | Configuration of the resulting yarn |
|---|---|---|---|---|
| Comparison | 222 | 100 | 12,000 | unbalanced condition |
| " | 120 | 100 | 12,000 | " |
| " | 222 | 100 | 10,000 | " |
| " | 120 | 100 | 10,000 | " |
| " | 222 | 100 | 8,000 | " |
| " | 120 | 100 | 8,000 | " |
| Present Invention | 80 | 100 | 12,000 | balanced condition |
| " | 50 | 100 | 12,000 | " |
| " | 80 | 100 | 10,000 | " |
| " | 50 | 100 | 10,000 | " |
| " | 80 | 100 | 8,000 | " |
| " | 50 | 100 | 8,000 | " |

Note:

When a piece of doubled and twisted yarn of 25 cm in length is separated into two component yarns, if the length difference between these two component yarns is less than 2 mm, this condition of the yarn configuration is referred to as balanced condition; on the other hand, if the above-mentioned length difference is more than 20 mm, this condition of the yarn configuration is referred to as an unbalanced condition.

The driving and position control mechanism applied to the traverse tube 4 will now be described with reference to FIGS. 7A and 7B.

Figure 7A:
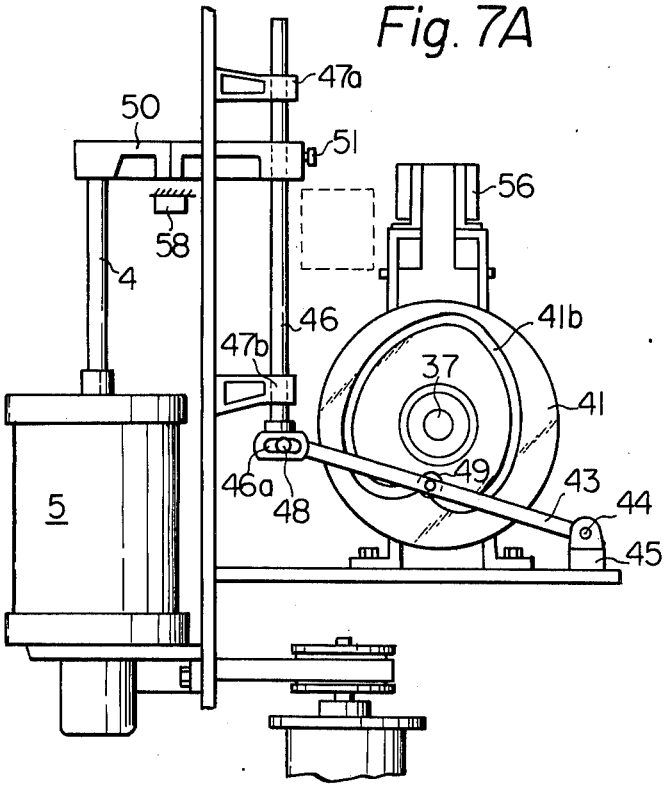
FIGS. 7A and 7B are schematic side and front views, respectively, of a mechanism for traversing the traverse tube in the apparatus shown in FIGS. 1, 2 and 3.
Figure 7B:
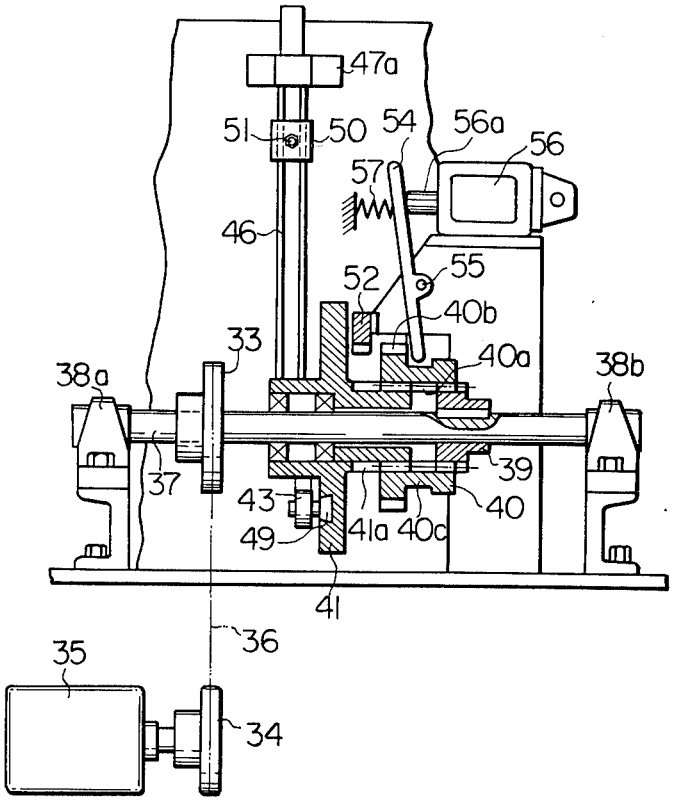

As will be apparent from FIGS. 7A and 7B, driving power is transmitted to a sprocket wheel 33 from a sprocket wheel 34 attached to a motor 35 through an endless roller chain 36. A driving shaft 37 is supported by bearings 38*a* and 38*b*, and it is integrated with the chain wheel 33 and a gear 39.

During the above-mentioned first step, as shown is FIG. 7B, an inner tooth 40*a* of an intermediate gear 40 is engaged with the driving gear 39 and, further, engaged with a gear 41*a* attached to a heat cam 41, which is turnably mounted on the shaft 37, whereby the driving power is transmitted to the heart cam 41. The heart cam 41 is provided with a guide groove 41*b* forming a closed loop as shown in FIG. 7A. An end of a link 42 is turnably supported by a pivot shaft 44 mounted on a bracket 45. A vertical sliding shaft 46 is slidably supported by a pair of plain bearings 47*a* and 47*b* in spline engaging condition. The shaft 46 is provided with a horizontal slot 46*a* wherein a free end of the link 43 is slidably engaged by way of a connecting pin 48. The link 43 is provided with a follower 49 projected toward the heart cam 41 from a middle portion of the link 43. The follower 49 is slidably engaged in the guide groove 41*b*. The shape of this closed loop (guide groove 41*b*) is so designed that the vertical traverse motion of the shaft 46 can be created by turning the heart cam 41. A connecting arm 50 secured to the traverse tube 4 is secured to the vertical shaft 46 by a fastening bolt 51. Therefore, the vertical traverse motion of the shaft 46 provides the vertical traverse motion of the traverse tube 4 in the rotary tube 5. The shape of the closed loop guide groove 41*b* of the heart cam 41 is so designed that the shaft 46 can be displaced upward and downward at a predetermined constant speed and, consequently, the constant speed downward and upward traverse motion of the tube 4 can be effectively created.

In the above-mentioned driving mechanism, the intermediate gear 40 is slidably mounted on the shaft 37 in such a condition that the gear 40 can be displaced along the axial direction of the shaft 37 and can be positioned at a first position where an inner tooth 40*a* of the gear 40 can be engaged with the gear 39 and the gear 41*a* so that the driving power of the shaft 37 is transmitted to the heart cam 41, and; the gear 40 can also be positioned at a second position where the inner tooth 40*a* of the gear 40 can be only engaged with the gear 41*a* so that power transmission from the shaft 37 to the heart cam 41 is stopped. In this condition, to stop the motion of the heart cam 41 at a predetermined angular precise position, a notched gear 52 is disposed at a particular position above the shaft 37 where an outer tooth 40*b* of the intermediate gear 40 can be engaged with the notched gear 52 when the gear 40 is displaced to the above-mentioned second position. The intermediate gear 40 is provided with an outside ring groove 40*c*. A lever 54 is turnably mounted on a pivot shaft 55 as shown in FIG. 7B, and a bottom end thereof is engaged in the groove 40*c*. The solenoid 56 is disposed to a machine frame at a position above the above-mentioned gear mechanism and a core rod 56*a* of the solenoid 56 faces a free end of the lever 54 in such a condition that when the solenoid 56 is energized, the core rod 56*a* is retracted into the solenoid 56 so that the other end of the lever 54 is moved to displace the intermediate gear 40 to its second position. On the other hand, when the solenoid 56 is de-energized, the core rod 56*a* is positioned at a projected position from the solenoid 56 where the free end of the lever 54 is pushed against the spring force of an expansion spring 57 so as to position the other end of the lever 54 at the engaging position with the outer ring shaped groove 40*c* of the intermediate gear 40 where the intermediate gear 40 is positioned at its first position. Accordingly, when the solenoid 56 is maintained in its de-energized condition, the intermediate gear 40 is postioned at its first position so that the driving force of the shaft 37 is transmitted to the heart cam 41, while when the solenoid 56 is energized, the intermediate gear 40 is displaced to its second position so that the motion of the heart cam 41 is stopped.

A non-contact limit switch 58 is disposed at a position adjacent to a downward and upward displacing motion of the connecting arm 50 where the above-mentioned condition $D_2 \geqq L_2$ is satisfied. An electric circuit to actuate the solenoid 56 is arranged in such a way that a magnetic relay (not shown), which is closed by an output signal of the counter 22 (FIG. 4) indicating the completion of the first step operation, and the circuit of the limit switch 58 are inserted in series, and this electric circuit is connected to a power source. Therefore, when the counter 22 issues a signal indicating the completion of the first step operation, the above-mentioned magnetic relay is closed, and; further, when the connecting arm 50 actuates the non-contact limit switch 58, the solenoid 56 is energized. Accordingly, the lever 56 is turned so as to displace the intermediate gear 40 to its second position and, thereby, the heart cam 41 is stopped at a desired angular position where the condition of the traverse tube 4 represented by $D_2 \geqq L_2$ is created.

Figure 6:
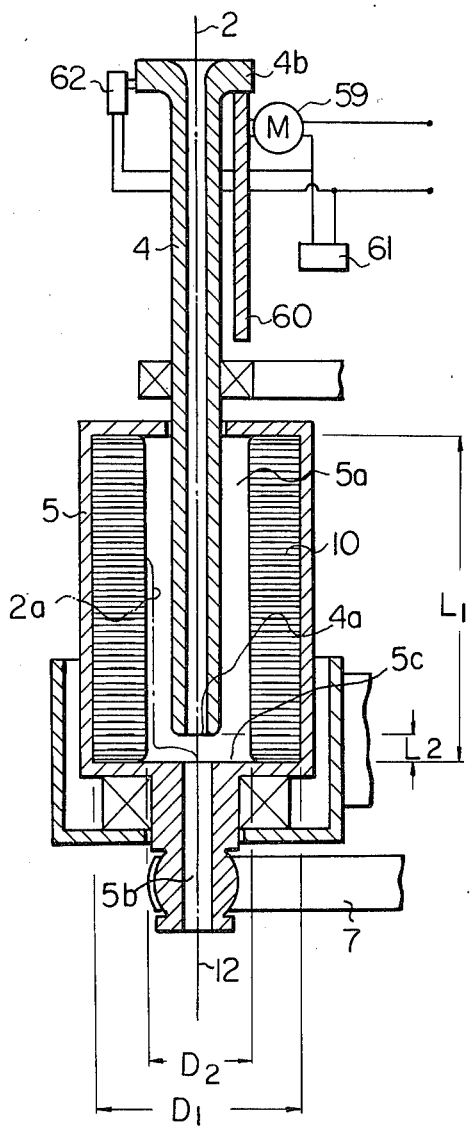
FIG. 6 is a schematic cross-sectional side view of the pot mechanism applied to the embodiment shown in FIG. 1, except for a mechanism for traversing the traverse tube.

The other mechanism for driving and positioning the transverse tube 4 during the first and second step operations is hereinafter explained briefly with reference to FIG. 6.

A switch 61 is turned on to turn a motor 59, and by rotation of the motor 59, a heart cam 60, which always is urged to a top flanged portion 4*b* of the traverse tube 4, is rotated to move the traverse tube 4 vertically at a prescribed interval. The motor 59 is operated by an AND circuit comprising a circuit including the switch 61 and a circuit including a limit switch 62. The limit switch circuit 62 is arranged so that every time the traverse tube 4 is lifted or lowered to a certain position, a part of the traverse tube 4 falls in contact with the limit switch 62 to turn it off. Accordingly, if the switch 61 is turned off, the vertical movement of the traverse tube 4 is continued until the limit switch 62 is turned off. A suitable mechanism is used for stopping the traverse tube 4 when it is lifted or lowered to a prescribed position, so that the traverse tube 4 can be stopped at the prescribed position assuredly.

It is especially preferred that the above driving and position-controlling element be arranged so that the traverse tube 4 is stopped while it is making an upward movement, because holding of the yarn in the pot 5 can be performed very assuredly in this case. The swtich 61 may be turned on and off depending on the yarn tension or co-operatively with other elements. Further, the switch 61 may be operated independently.

Figure 8B:
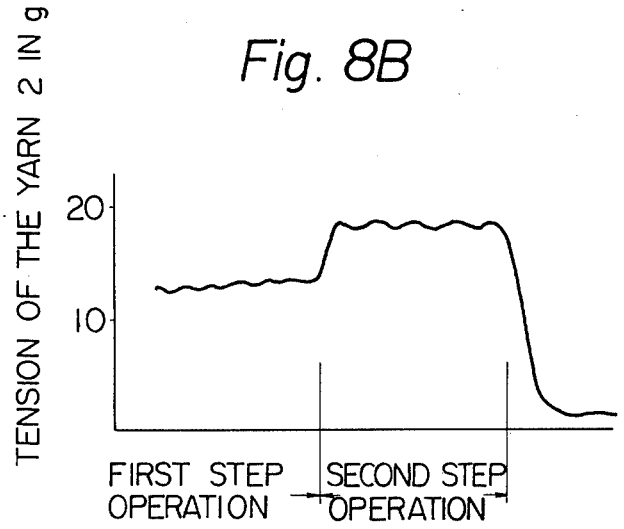
FIG. 8B is a diagrammatical expression indicating the variation of the yarn tension of the yarn feeding into the pot during the entire operation of the method for doubling and twisting yarns according to the present invention.
Figure 8A:
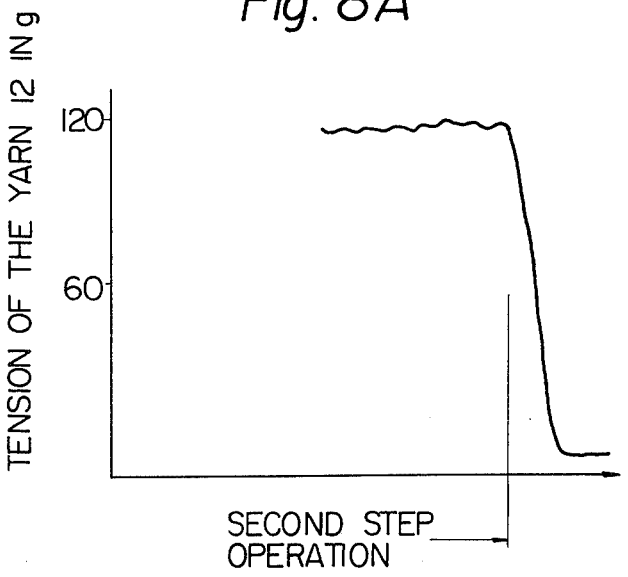
FIG. 8A is a diagrammatical expression indicating the variation of the tension of the yarn delivered from the pot during the second step operation of the method for doubling and twisting yarns according to the present invention.

In this embodiment, the completion of the second step operation is detected by measuring the yarn tension of the doubled and twisted yarn 12 delivered from the pot 5, because it was observed that when the second step operation is completed, the yarn tension of the yarn 12 is remarkably reduced, for example, from a high level of yarn tension to a very low level as shown in FIG. 8A. Such type of sudden change of yarn tension of the material yarn 2 was also observed as shown in FIG. 8B. Therefore, instead of applying the method utilizing the counter hereinbefore, explained, a device for measuring the tension of the yarn 2 can be effectively utilized to detect the completion of the first step operation.

Figure 9:
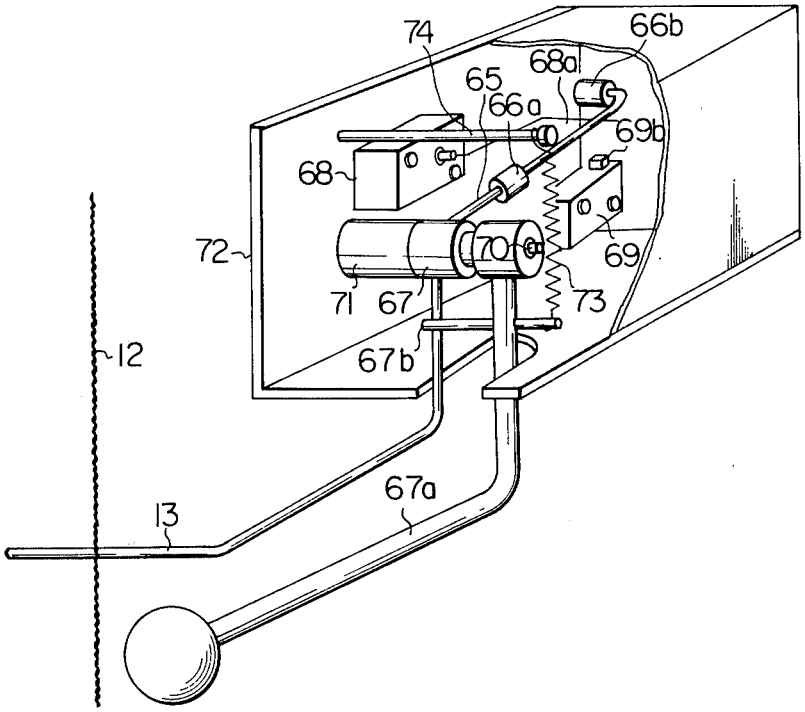
FIG. 9 is a perspective view of a device for measuring the tension of the yarn delivered from the pot, which is utilized for the apparatus shown in FIGS. 1, 2 and 3.

A device for detecting completion of the second step, namely the feeler 13, will now be described with respect to its structure, function and effect with reference to FIG. 9. While the yarn is running, the feeler 13 is urged by the yarn tension, but when the yarn is broken or the second step operation is completed, or abnormal winding of the yarn on the traverse tube 4 is created, the yarn tension is reduced remarkably and, consequently, a level 65 is lowered by the weight of counter weights 66*a* and 66*b* disposed behind a boss 67. In this condition, an operation signal is emitted to a cutter 14 (see FIG. 3) by a detecting lever 68*a* of a limit switch 68, and when a detecting nob 69*b* of the limit switch 69 is depressed by the counter weight 66*b*, emission of the operation signal to the cutter 14 is stopped. When the yarn-threading operation is conducted, since the boss 67 of the feeler 13 and operation lever 67*a* are disposed in such a condition that they can turn freely around a shaft 70 fixed to a boss 71 attached to a frame 72, if the operation lever 67*a* is pressed, an auxiliary lever 67*b* expels the feeler 13 to the yarn running position and the feeler 13 is retained in this state. More specifically, the feeler 13 is self-retained by a toggle mechanism including a pulling coil spring 73 disposed between an auxiliary lever 67*b* and a supporting rod 74.

As it will be apparent from the foregoing illustration, in the apparatus for doubling and twisting yarns according to the present invention, which is shown in FIGS. 1 and 2, completion of the second step is detected based on the change of the yarn tension. In the present invention, instead of such detecting system, there may be adopted a detecting system in which a detector for detecting the variation of the yarn thickness is disposed in an intermediate zone between the rotary pot 5 and the winding mechanism 9 for producing the yarn package, and completion of the second step operation is detected based on the distinguished change of the thickness of the yarn. This detecting method and device will now be described in detail. In the embodiment shown in FIG. 10 the thickness of the yarn 12 running between the rotary pot 5 and the take-up rollers 8*a*, 8*b* is detected. Since the thickness of the yarn 12 is reduced to ½ when the yarn stored in the rotary pot 5 is consumed and only the yarn 2 fed from the feed roller is present in the pot 5, at this time it is judged that the second step is completed. Namely, the detecting method of this embodiment is characterized in that the structure is arranged in such a way that, at the above-mentioned time, the single yarn 2 running in the intermediate zone between the rotary pot 5 and the take-up rollers 8*a*, 8*b* is automatically cut. The feed side end portion of the thus cut yarn 2 contacts the pot 5, whereupon it is swung around by the rotation of the pot 5 and returned to the interior of the rotary pot 5 by the centrifugal force. Thus, the feed side end portion of the cut yarn 2 is placed on the inner wall of the rotary pot 5 and the first step of winding the yarn 2 on the rotary pot 5 is started again while imparting primary twists thereto. During the second step operation, it sometimes happens that an abnormally thick yarn, for example, a 4-plied, 6-plied or 8-plied yarn, is formed because the yarn 2*a* taken out from the pot 5 is accompanied by other yarn 2*c* under some conditions as shown in FIG. 11. Continuation of the second step operation in this condition is very dangerous and there is brought about a risk that the apparatus will be damaged.

Another characteristic feature of the detecting system of this embodiment is that the structure is arranged so that when formation of an abnormal yarn having a thickness larger than that of the normal doubled and twisted yarn 12 is detected, the thicker abnormal yarn running in the intermediate zone between the rotary pot 5 and the take-up rollers 8*a*, 8*b* is immediately cut. It is preferred to construct the detecting device in such a way that feeding of the material yarn 2 and rotation of the rotary pot 5 are simultaneously stopped by the signal emitted on detection of formation of thicker abnormal yarn.

The structure and function of the mechanism for working this detecting system will now be described in more detail by reference to the embodiment shown in FIGS. 10 and 11.

Figure 10:
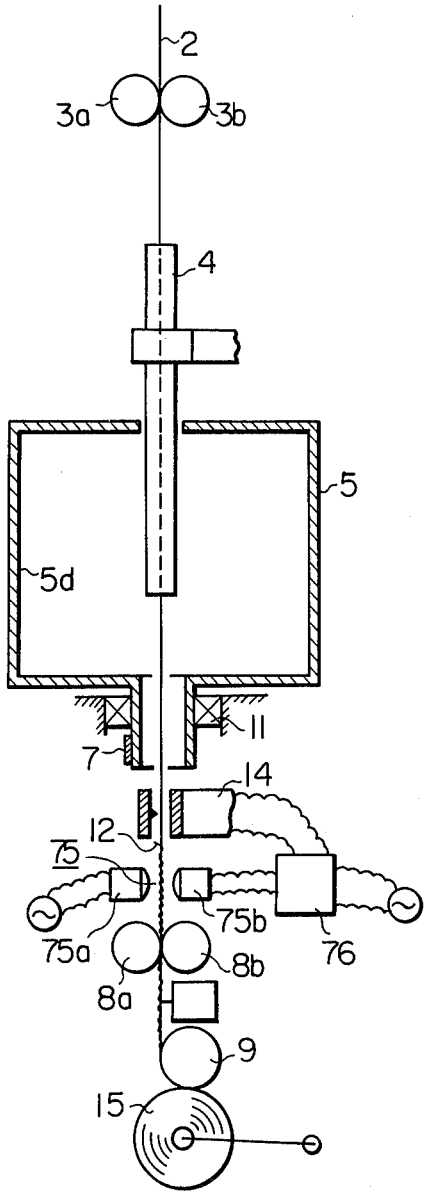
FIGS. 10 and 11 are schematic side views, partly in section, of the apparatus according to the present invention, wherein the variation of the yarn thickness of the yarn delivered from the pot is measured.
Figure 11:
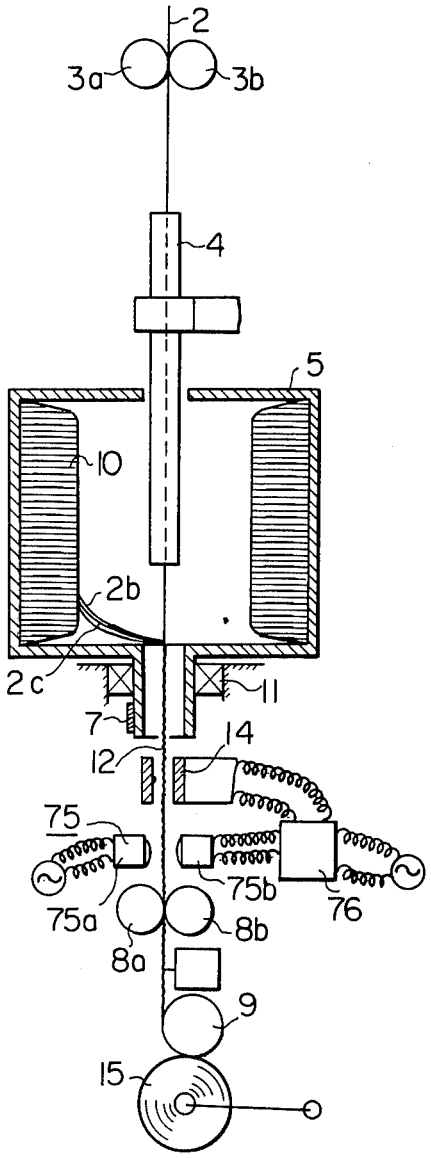

FIG. 10 illustrates the state of completion of the second step operation where the primary twist yarn 2*a* stored in the rotary pot 5 has been consumed away and only the yarn 2 fed from the feed rollers 3*a* and 3*b* is present in the rotary pot 5. As shown in FIG. 10, a yarn cutting mechanism 14 and the yarn thickness detector 75 are successively disposed at a position between the rotary pot 5 and take-up rollers 8*a* and 8*b* so that they are co-operative with each other. When the second step operation is completed and the doubled state of yarn 12 is converted to the condition of single yarn, the thickness of the yarn delivered from the pot 5 is reduced to ½ in denier. This reduction of the yarn thickness is detected by detector and the yarn cutting mechanism 14 is actuated through a control circuit 76 to cut the running yarn delivered from the pot 5. Thereafter, the feed side end portion of the cut yarn is returned into the rotary pot 5 and is placed on the inside wall 5*d* of the pot 5 by the centrifugal force created by rotation of the pot 5.

The detector 75 issues a signal to actuate the cutting mechanism 14 and also the solenoid 56 (in FIG. 7B) by way of a magnetic relay (not shown). When the above-mentioned magnetic relay is actuated, the connection between the solenoid 56 and an electric source is opened so that the solenoid 56 is de-energized. Consequently, the intermediate gear 40 engages with both gears 39 and 41*a* so that the normal traverse motion of the traverse tube 4 is commenced again. Accordingly, the first step operation is conducted again in the same manner as described hereinbefore. Reduction of the yarn thickness to ½ is detected in the foregoing manner.

Next, detection of formation of an abnormal yarn having a thickness several times as large as the thickness of the normal doubled and twisted yarn 12 is explained in more detail. While the yarn 2*a* stored in the rotary pot 5 is being taken out during the second step operation, it often happens that the withdrawn yarn 2*b* is accompanied by other yarn 2*c* introduced into the yarn passage below the traverse tube 4 as shown in FIG. 11. Therefore, abnormally thicker yarn is produced. However, such abnormal yarn can be detected by the detector 75. More specifically, when the thickness of the yarn in denier is at least 1.5 times as large as the thickness of the normal doubled and twisted yarn 12, this growth of the thickness is detected by the thickness detector 75 and the yarn cutting mechanism 14 is actuated through the control circuit 76 to cut the yarn involving abnormal yarn 2*c.* In order to prevent occurrence of accidents due to the above-mentioned creation of abnormal yarn, it is preferred that in response to a signal of detection of formation of an abnormal thicker yarn 2*c,* feeding of the yarn 2 and rotation of the rotary pot 5 be simultaneously stopped. If the yarn thickness detector 75 is disposed between the pot 5 and the take-up rollers 8*a,* 8*b* as indicated above, changeover of the second step operation to the fist step operation can be accomplished automatically, and simultaneously, formation of an abnormal thicker yarn can be detected and an appropriate treatment can be performed for preventing the occurrence of an accident due to such abnormal yarn.

In the embodiment shown in FIGS. 10 and 11, the detector 75 is a known photoelectric type thickness detector provided with a light projector 75*a* and a photoelectric tube 75*b,* and it is so designed that an allowable thickness of the doubled and twisted yarn 12 which can pass through the thickness detector 75 is 0.5 to 1.5 times the prescribed normal thickness of the twisted yarn 12. The detector 75 is not limited to those specifically illustrated in FIG. 10, but the electrostatic volume type or the pneumatic type yarn thickness detector may be adopted. Further, the disposed position thereof is not limited to the zone between the rotary pot 5 and take-up rollers 8*a* and 8*b* but, needless to say, the detector 75 may be located between the take-up rollers 8*a* and 8*b* and the winding mechanism 9.

In the practice of operating the apparatus according to the present invention, some problems to be solved are encountered. One of such problems relates to adjustment of the relation between the speed of feeding the material yarn 2 to the pot 5 from the feed rollers 3*a,* 3*b* and the speed of taking out the doubled and twisted yarn 12 from the pot 5 during the above-mentioned second step operation, namely adjustment of the relaxing ratio suitable for twist-shrinkage caused by imparting twists to the yarn. However, even if the above-mentioned problem is solved, it is necessary to eliminate the differences in yarn configuration which can appear due to the differences in spindles and time sequence in the operation, that is, the change of diameter of the yarn package 10 formed in the pot 5 during the second step operation, so as to produce a good quality yarn. It is particularly important to eliminate such problem in the case of producing yarn for industrial end use because, if the configuration of the doubled and twisted yarn is formed in an unbalanced condition, the tenacity of the doubled and twisted yarn is reduced remarkably.

Various experiments were conducted on the relationship between the speed of supplying the material yarn 2 and the speed of taking up the doubled and twisted yarn 12 with a view to solving the above-mentioned problem. As a result, it was found that when the feed rollers 3*a,* 3*b* and the take-up rollers 8*a,* 8*b* are co-operatively driven by one common drive source and the rotation speed of one of these rollers is minutely adjusted at a pitch not larger than 0.5%, a doubled and twisted yarn, in which the length of the component yarns are quite the same or substantially equal, can be produced. These experiments will now be described.

Figure 12:
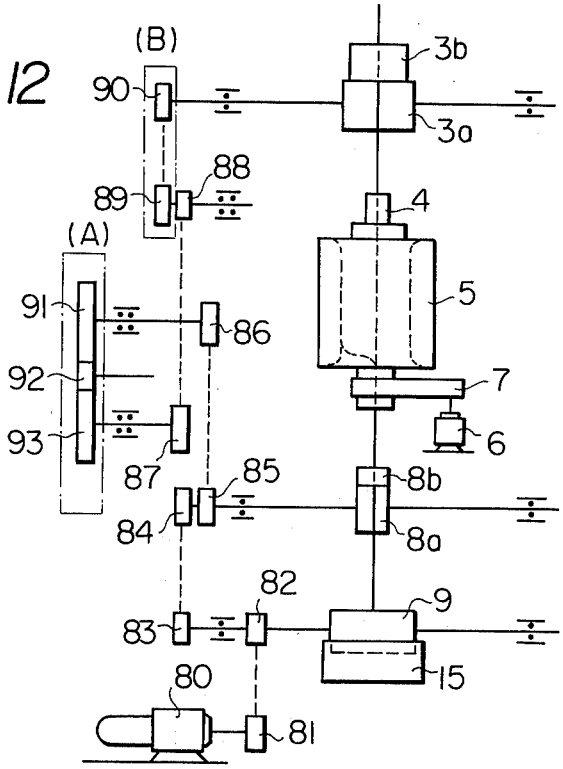
FIG. 12 is a schematic representation of the gear diagram utilized for the apparatus according to the present invention.

By using the doubling and twisting apparatus of the present invention shown in FIG. 12, polyamide multifilament yarn (1260-D, 204-F) was processed. More specifically, a package of the primary twist yarn 2*a* was formed in the rotary pot 5 during the first step operation. Changeover from the first step operation to the second step operation was then conducted and the material multifilament yarn 2 was doubled and twisted with the primary twisted yarn 2*a* in the rotary pot 5. In both the first and second step operations, the rotation speed of the rotary pot 5 was made equal to the rotation speed of yarn feed rollers 3*a* and 3*b,* so that the number of twists given to the primary twist yarn 2*a* was equal to the number of twists given to the doubled and twisted yarn 12.

Figure 13:
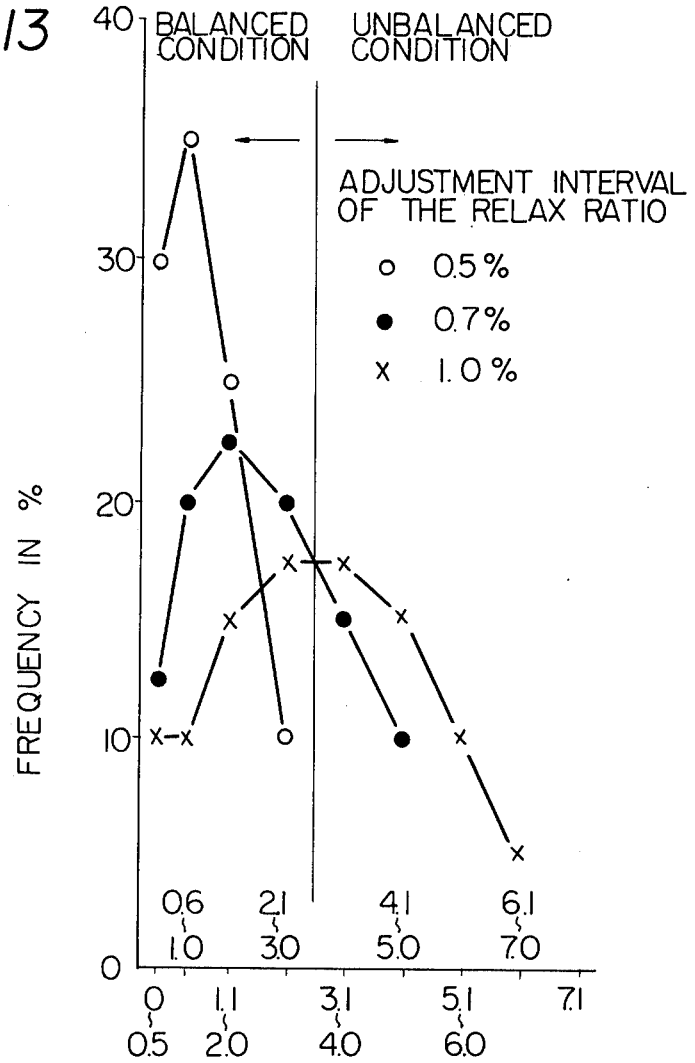
FIG. 13 is a graphical representation indicating the relation between the length difference between two component yarns of a doubled twisted yarn separated from the doubled-twisted yarn of 250 mm cut-length and the frequency thereof.

Four standards of the rotation speed of the rotary pot 5, namely 6,000, 8,000, 10,000 and 12,000 rpm, were adopted and 10 standards of the number of twists imparted to the yarn were set at pitches of 20 turns per meter in the range of 320 to 500 turns per meter. Thus, 40 operational standards were set, and 5 experiments were carried out with respect to each operational standard. A gear assembly device (detailed hereinafter) capable of adjusting the relaxing ratio, namely the ratio of the surface speed of the yarn feed rollers 3*a* and 3*b* to the surface speed of the yarn take-up rollers 8*a* and 8*b,* at pitches of 0.5%, 0.7% and 1.0% with respect to each operational standard was used, and the gear adjustment of the relaxing ratio was carried out at each pitch. Among the resulting twisted and doubled yarns, namely cords, a product having the best balance of yarn configuration which was obtained under each optimum condition, was chosen and a test piece having a length of 250 mm was cut from this product. Each test piece was separated into the respective two component yarns and the difference of the length between the two component yarns was examined to determine whether or not the shrinkage by twist and spiral condition thereof were equal between the two component yarns. The results shown in FIG. 13 were obtained. A homogeneous cord in which the length difference between the two component yarns separated from the 250 mm-long test piece was smaller than 3.0 mm was most preferred as a tire cord, and; it was found that a product, in which the above length difference was larger than 5.0 mm, could not be used as a tire cord at all, because of an unbalanced configuration of the component yarns. As will be apparent from the results shown in FIG. 13, any of the cords obtained by conducting adjustment of the relaxing ratio at a pitch of 0.5% had a yarn length difference not larger than 3.0 mm/250 mm, as determined according to the above method, and was excellent in comparison to the products obtained by conducting adjustment of the relaxing ratio at pitches of 0.7% and 1.0%.

It was confirmed that in that case of utilizing a doubling and twisting apparatus according to the present invention wherein the peripheral speed ratio between the yarn feed rollers 3*a* and 3*b* and the yarn take-up rollers 8*a* and 8*b* could be adjusted at a pitch not larger than 0.5%, the versality to various twist number standards and pot rotation number standards was excellent over the case where a doubling and twisting apparatus of the same type as the present invention was used wherein the peripheral speed ratio between the yarn feed rollers 3*a* and 3*b* and the yarn take-up rollers 8*a* and 8*b* could be changed at a pitch of 0.7% or 1.0%.

The driving system for the doubling and twisting apparatus shown in FIG. 12 will now be described.

Yarn feed rollers 3*a* and 3*b*, yarn take-up rollers 8*a* and 8*b* and winding device 9 are driven by a motor 80 through pulleys 81 to 90 and gears 91 to 93, and they are co-operative with one another. In this case, the peripheral speed of the yarn take-up rollers 8*a* and 8*b* is identical to the take-up speed of the winding mechanism 9, however it is preferable that the take-up speed of the winding mechanism 9 is made slightly higher than the peripheral speed of the take-up rollers 8*a* and 8*b*, so that the doubled and twisted yarn 12 is stretched to such an extent as will not cause slackening in the doubled and twisted yarn 12. The number of twists per unit length of the doubled and twisted yarn 12 is changed depending on the number of rotation of the pot 5 per unit of time and the peripheral speed of the yarn take-up rollers 8*a* and 8*b*, and; the doubled and twisted condition of the yarn 12 is influenced by the number of rotation of the pot 5 per unit of time and the peripheral speed ratio between the yarn feed rollers 3*a* and 3*b* and the yarn take-up rollers 8*a* and 8*b*. If the pot 5 is driven at a constant speed, the doubled and twisted condition, namely, the length ratio between component yarns in the doubled and twisted yarn, can be changed by adjusting the peripheral speed ratio between the yarn feed rollers 3*a* and 3*b* and the yarn take-up rollers 8*a* and 8*b*, namely the relaxing ratio.

Change or adjustment of the peripheral speed ratio between the yarn feed rollers 3*a* and 3*b* and the yarn take-up rollers 8*a* and 8*b* can be accomplished by changing (A) the combination among the gears 91 to 93 and/or (B) the combination between the pulleys 89 and 90. A plurality of combinations are provided for each of the combinations (A) and (B) so that the peripheral speed ratio between the two pairs of rollers can be minutely adjusted at a pitch not larger than 0.5%. Since these yarn feed rollers 3*a* and 3*b* and yarn take-up rollers 8*a* and 8*b* are driven by one common drive source, it is sufficient to perform the adjustment of the peripheral speed ratio between limited parts of the power transmission mechanism and the minute adjustment can be remarkably facilitated.

It was found that in order to obtain cord yarns applicable to industrial uses appropriately, it is very necessary and important to reduce to a minimum level the variation of the length difference between two component yarns within each spindle (pot) which is caused by the difference of the wound diameter of the yarn package formed in the pot or the difference of the winding position with respect to the direction of the pot axis. If this problem is solved, the effective space in the pot for forming the yarn package of the primary twisted yarn is increased, and production of doubled and twisted yarn can be conducted with a very high efficiency according to the present invention.

This problem is effectively solved if, in the above driving system, the yarn feed rollers 3*a* and 3*b* and the yarn take-up rollers 8*a* and 8*b* are driven by one common drive source in such a way that the peripheral speed ratio between the feed rollers 3*a* and 3*b* and the take-up rollers 8*a* and 8*b* is appropriately changed during the operation. More specifically, the peripheral speed ratio between the feed rollers and the take-up rollers, namely the relaxing ratio in the yarns running between these two pairs of rollers, is minutely adjusted so as to attain an appropriate value corresponding to the change of the tension caused by the differences in the wound diameter of the yarn package 10 formed in the pot 5 or the differences in the winding position with respect to the axial direction of the pot 5.

Figure 14:
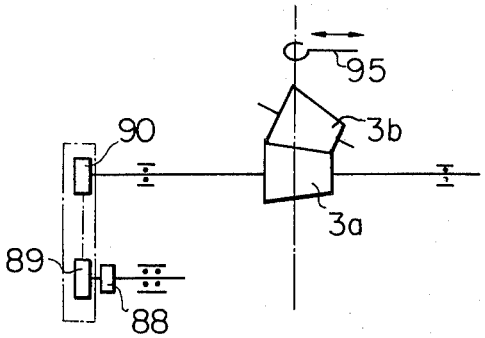
FIGS. 14 and 15 are schematic front views of the other embodiments of the feed mechanism which may be utilized for the apparatus according to the present invention.

As pointed out hereinbefore, even if the relaxing ratio is set to a certain value in advance, since the inside diameter of the yarn package 10 in the pot 5 is continuously increased, the yarn tension is inevitably changed during the operation and, therefore, the yarn length difference is inevitably changed with the lapse of time. Accordingly a uniform doubled and twisted state cannot be obtained. In an embodiment shown in FIG. 14 this disadvantage is overcome in the following manner. That is, a feed roller 3*a* and a nip roller 3*b* are arranged so as to have a conical shape in which the diameter is changed in the axial direction of the roller. A yarn guide 95 is disposed in such a way that when the guide 95 is moved in the axial direction of the roller 3*a*, the peripheral speed ratio between the feed rollers 3*a* and 3*b* and the yarn take-up rollers 8*a* and 8*b* can be changed during the operation. The embodiment shown in FIGS. 1, 2 and 3 utilizes the feed rollers 3*a*, 3*b* of this type.

Figure 15:
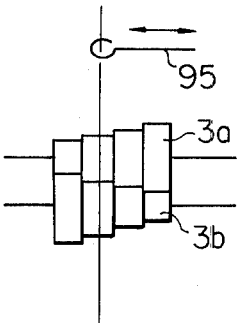

FIG. 15 illustrates an embodiment in which stepped rollers are used as the yarn feed rollers. In this embodiment, the peripheral speed ratio between the feed rollers 3*a*, 3*b* and the take-up rollers can be changed stepwisely. Each step of the nip roller 3*b* is separated desirably and driven independently of the others.

As will be apparent from the foregoing illustration, since both the feed and take-up rollers are driven by one common drive source, the change of the peripheral speed ratio between these rollers is reduced and this ratio is kept relatively stable. In addition, if a yarn passage is set in the rollers, the relaxing ratio is kept constant between both the rollers. Still further, if the traverse guide is moved to a yarn passage set so as to correspond to the inside wound diameter of the yarn package in the pot or the tension at the doubling and twisting step, the relaxing ratio can be minutely adjusted while the peripheral speed ratio between both the rollers is kept constant stably. Accordingly, the interior of the pot can be effectively utilized as a winding spaced and a large package of the primary twist yarn can be formed in the pot.

This effect by the minute adjustment of the peripheral speed ratio between feed rollers 3*a* and 3*b* and take-up rollers 8*a* and 8*b* was confirmed by the following experiments.

EXPERIMENT 2

Feed rollers 3*a*, 3*b* and take-up rollers 8*a*, 8*b*, in each of which the diameter was not changed, were driven by one common drive system. A polyamid multifilament yarn (1260-D - 204-F) was first subjected to the primary twist treatment in the pot 5 in which the inside wound diameter of the yarn package 10 was changed from 160 mm to 100 mm at a pot driving speed of 10,000 rpm, a peripheral speed of the feed rollers of 27.6 m/min and a relaxing ratio of 11% (a take-up roller speed of 24.6 m/sec). Then, the primary twist yarn 2*a* was taken out from the pot 5 and doubled and twisted with the yarn 2 delivered from the traverse tube 4 of the pot 5, so that the inside wound diameter in the pot was increased from 100 mm to 160 mm. When the doubling and twisting operation, which is the second step operation, was conducted at an inside wound diameter of 100 mm, the average yarn length difference between two component yarns was 3 mm and the maximum difference therebetween was 5 mm. When the doubling and twisting operation was conducted at an inside wound diameter of 160 mm, the average yarn length difference between two component yarns was 0.8 mm and the maximum difference therebetween was 2 mm. Thus, the doubled and twisted yarn obtained by conducting the doubling and twisting at an inside wound diameter of 160 mm had good quality, but the doubled and twisted yarn obtained at an inside wound diameter of 100 mm was not suitable as a tire cord. The amount of the good tire cord obtained in this experiment was about 1 kg.

EXPERIMENT 3

A tapered roller in which the roller diameter was changed by 0.15% at 5 mm traverse was used as the feed roller 3*a* and nip roller 3*b*, respectively. By adoption of these rollers, the relaxing ratio was set at 11.0% at a wound diameter of the yarn package in the pot of 160 mm, and when the wound diameter was changed by 20 mm, the yarn passage was displaced along the axial direction toward increasing the diameter of the roller by 5 mm. Namely, at the wound diameter of 100 mm, the yarn passage was displaced by 15 mm and the relaxing ratio was adjusted to 11.45%. In this manner, the yarn passage on the roller was displaced during both the first step operation and the second step operation. Other conditions were the same as in Experiment 2. In each of the doubled and twisted yarn obtained by conducting the doubling and twisting at an inside wound diameter of the yarn package in the pot of 100 mm and the doubled and twisted yarn obtained by conducting the doubling and twisting at an inside wound diameter of the yarn package in the pot 160 mm, the average yarn length difference between two component yarns was 0.8 mm and the maximum difference thereof was 2 mm, and a good tire cord was obtained throughout the entire package of a 3.2 kg.

Another problem to be solved in practically working the present invention is how to deal with abnormal winding of the yarn 2 on the traverse guide tube 4 during the first step operation. This is because, when such abnormal winding takes place, the tension on the yarn 2 is drastically reduced (substantially to zero). Accordingly, this problem can be solved by detecting this change of the yarn tension and automatically cutting running yarn 2 at a position upstrean of the feed rollers, in response to a signal of this detection of the tension change, and automatically stopping the rotation of the pot 5 simultaneously with cutting of the yarn 2.

Figure 16:
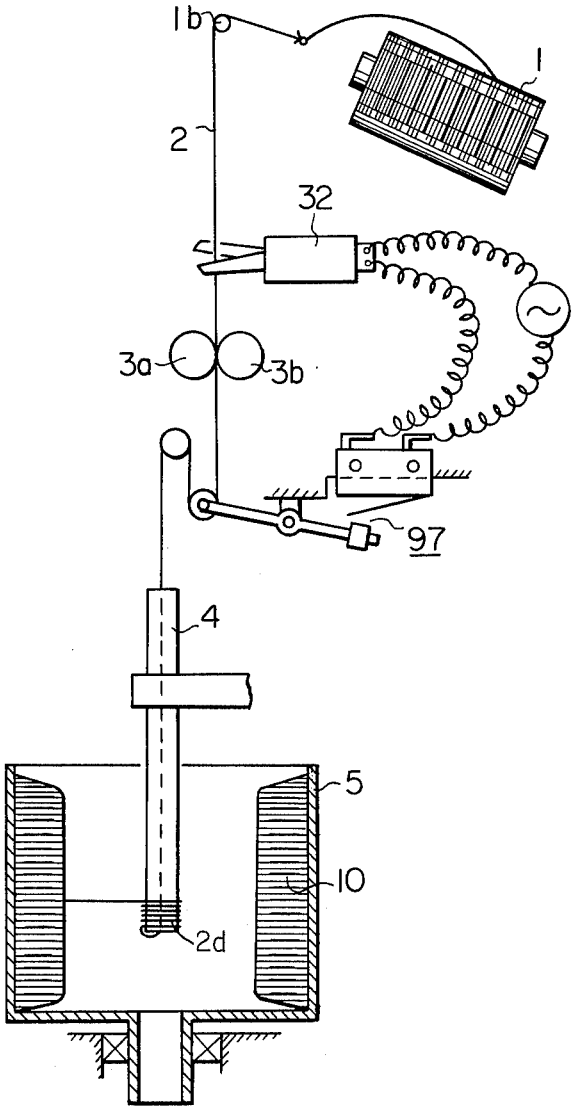
FIG. 16 is a schematic side view, partly in section, of the doubling, twisting apparatus according to the present invention.

More specifically, as illustrated in FIG. 16, a yarn tension detecting device 97 is disposed between the feed rollers 3*a* and 3*b* and the traverse tube 4, and a yarn cutter 32 is disposed upstream of the feed rollers 3*a* and 3*b*. These members are connected to one another electrically or mechanically so that the yarn cutter 32 is actuated by the output of the tension detecting device 97. During ordinary operations the yarn cutter 32 is opened, and when an abnormal winding 2*d* takes place, the resulting reduction of the yarn tension is detected by the yarn tension detecting device 97 and, in response to the detection signal, the yarn cutter 32 is actuated to cut the running yarn 2.

If circuits are arranged so that the rotation of the pot 5 is stopped in response to the detection signal of the yarn tension detecting device 97, there is provided such advantages that accidents can be prevented and a threading operation can be performed smoothly in a short time.

The yarn tension detecting device 97 used in the present invention is not limited to one of the cantilever type specifically shown in FIG. 16, but an ordinary limit switch type device may be used. Further, the yarn cutter 32 is not limited to the one specifically shown in FIG. 16, but a customarily used mechanism including a blade or heating wire may be used in the present invention.

Next, the method for carrying out the doubling and twisting operation by the apparatus shown in FIGS. 1, 2, 3 and 4 is hereinafter summarized with reference to FIGS. 17, 18 and 19.

Figure 17:
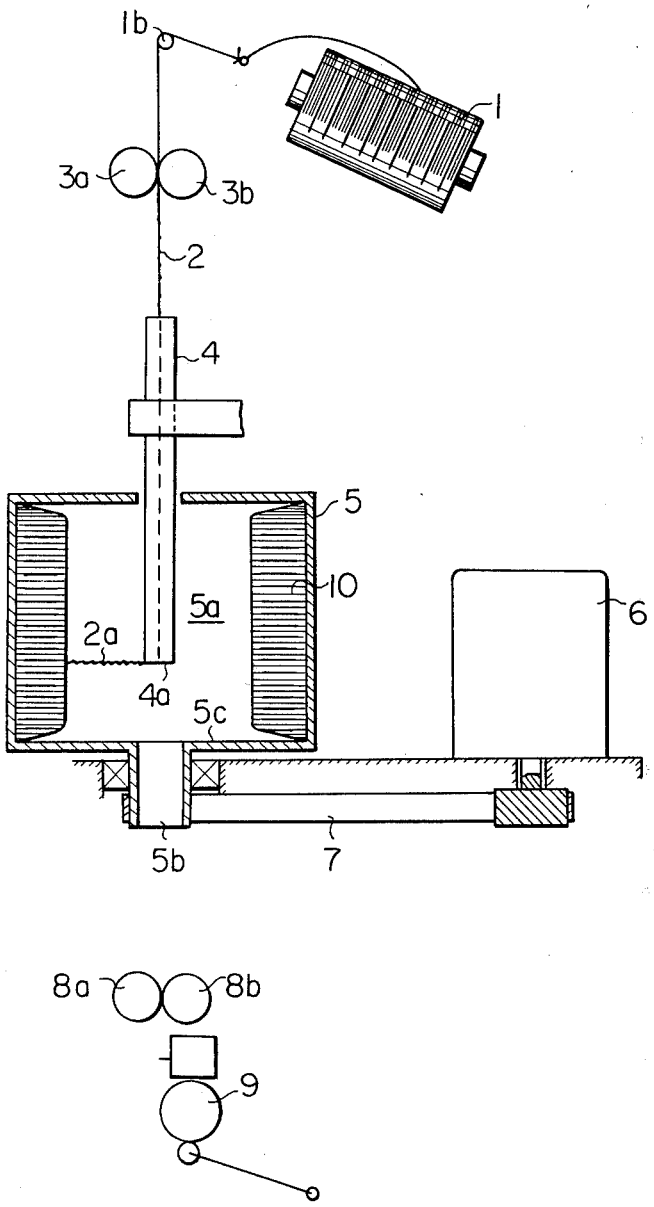
FIGS. 17, 18 and 19 are schematic side views, partly in section, of the doubling, twisting apparatus shown in FIGS. 1, 2 and 3 indicating the stepped operation for producing the doubled and twisted yarn having a good balanced configuration of the component yarns.

Referring to FIG. 17, illustrating the first step operation, the yarn 2 is fed from the yarn package 1 to the rotary pot 5 through the traverse tube 4, by means of the feed rollers 3*a* and 3*b*. The traverse tube 4 has a structure in which tube 4 is vertically moved by a traverse device (not shown) and, hence, the yarn 2 is wound on the inner wall of the rotary pot 5 while a single yarn twist is imparted thereto. Accordingly, during this first step operation, the take-up rollers 8*a* and 8*b* and the winding mechanism 9 need not be operated, and while the first step operation is being conducted, doffing of a package on the winding mechanism 9 may be accomplished conveniently.

In this embodiment, when the predetermined length of the yarn 2 is deposited in he rotary pot 5, the counter 22 (FIG. 4) issues a signal to actuate the solenoid 56 (see FIG. 7B). When the limit switch 58 (see FIG. 7A) is actuated, the connection between the solenoid 56 and the electric source (not shown) is closed so that the solenoid 56 is actuated to stop the traverse motion of the traverse tube 4 in such a way that the botton end of the traverse tube 4 is located at a position where the condition $D_2 \geqq L_2$ is satisfied. In this condition, when the yarn portion between the yarn package 10 formed in the pot 5 and the bottom end 4*a* of the traverse tube 4 is taken out from the aperture 5*b* formed at the bottom portion of the pot 5, the primary twisted yarn 2*a* of the yarn package 10 formed in the pot 5 and the yarn 2 fed from the feed rollers 3*a* and 3*b* are doubled and delivered from the aperture 5*b* of the pot 5 while imparting twists thereto. The doubled and twisted yarn then passes through the take-up rollers 8*a* and 8*b*.

In the above-mentioned doubling and twisting operation, the primary twists imparted to the material yarn 2 during the first step operation is eliminated because of unwinding the primary twisted yarn 2*a* from the yarn package 10 during the second step operation.

Figure 18:
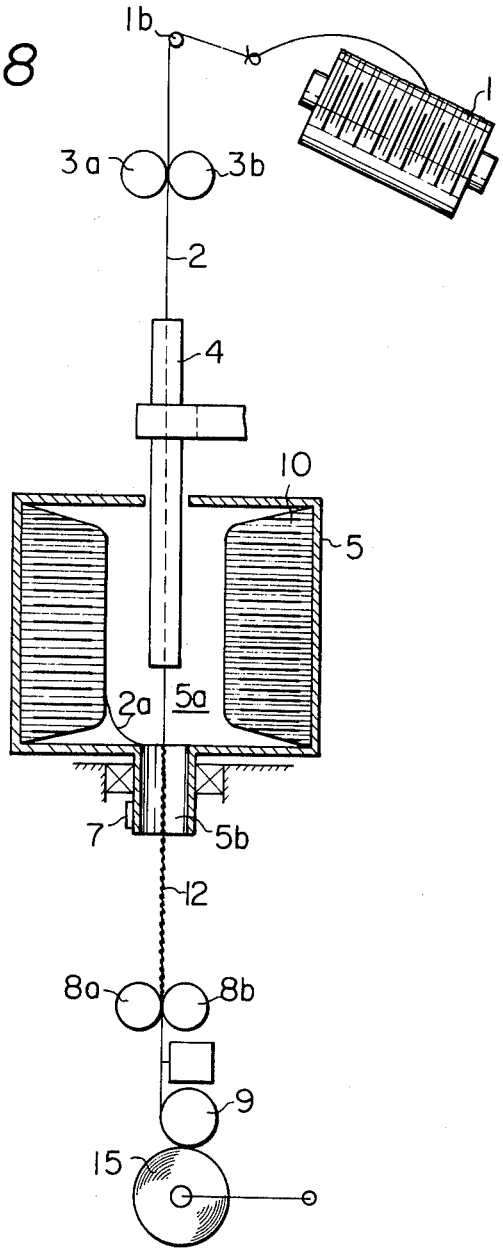
Figure 19:
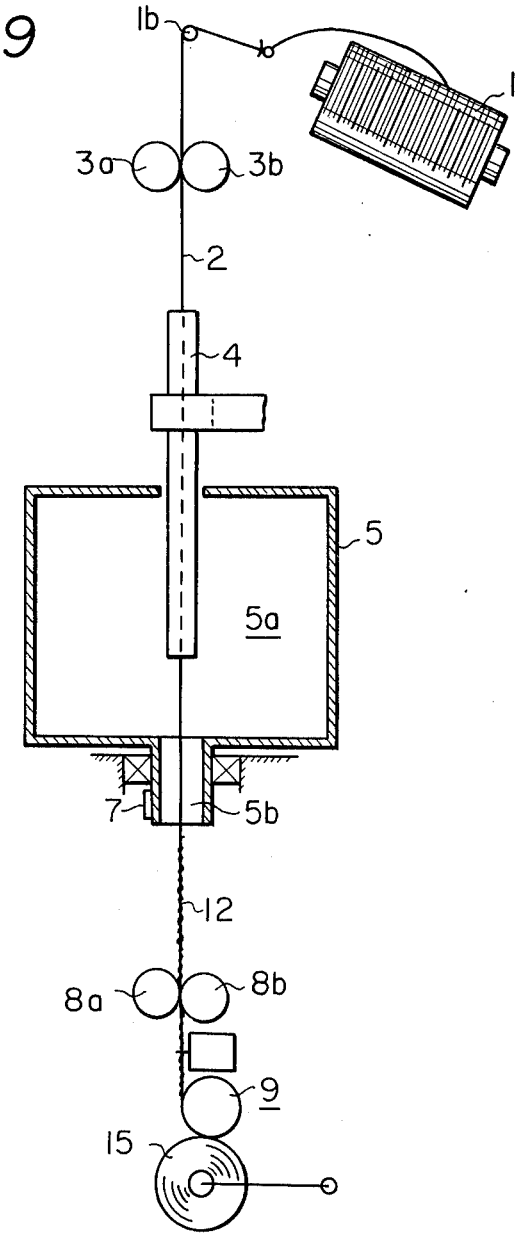

Thus, the second step is initiated and the resulated doubled and twisted yarn 12 is wound as a package 15 by the winding mechanism 9, as illustrated in FIG. 18. FIG. 19 illustrates the state of completion of the second step operation where the yarn 2*a* stored in the rotary pot 5 is consumed and only the material yarn 2 is fed from the feed rollers 3*a* and 3*b*.

In the apparatus shown in FIGS. 1 and 2, a yarn tension detector provided with a feeler 13 and a yarn cutting mechanism 14 are disposed between the rotary pot 5 and the take-up rollers 8*a* and 8*b*. Abrupt reduction of the tension of the yarn 12 at the time of completion of the second step operation is detected by the feeler 13 of the yarn tension detector and the yarn cutting mechanism 14 is actuated in response to a detection signal issued from the tension detector to cut the yarn 12. The feed side end of the yarn 12 is returned into the rotary pot 5 by the centrifugal force imposed on the yarn and pressed to the inner wall of the rotary pot 5.

When the yarn tension detector detects the completion of the second step operation, the signal issued from the yarn tension detector is also transmitted to the solenoid 56 (FIG. 7B) so as to de-energize the solenoid 56 so that the intermediate gear 40 meshes with the gears 39 and 41*a*. Accordingly the normal traverse motion of the traverse tube 4 for carrying out the first step operation is started. Therefore, the second step operation can be automatically changed to the first step operation.

As already explained, it is preferable to change the peripheral speed ratio between the feed roller 3*a*, 3*b* and the take-up rollers 8*a*, 8*b* so as to adjust the relax condition of the material yarn fed into the pot to produce a yarn having a balanced configuration of two component yarns. Such doubled and twisted yarn having the above-mentioned desirable configuration is suitable to use a tire cord.

What is claimed is:

1. A method for doubling and twisting a material yarn by a two-step changeover system by means of a pot twisting and winding device, wherein said material yarn is fed into said pot by way of a traverse tube being reciprocally displaced upwardly and downwardly along an axial center of said pot during a first step operation so that a yarn package of a primary twisted yarn created from said material yarn is formed upon an inside cylindrical wall of said pot, upon completion of forming said yarn package of said primary twisted yarn, a second step operation starts in which said primary twisted yarn is unwound from said yarn package so as to double with said material yarn supplied through said traverse tube while eliminating the primary twists imparted thereto, and said doubled yarn is twisted simultaneously to said doubling operation; and, during the second step operation, upon completion of unwinding of said primary twisted yarn from said yarn package formed in said pot, said second step operation is stopped and said first step operation is commenced again, said first step operation and second step operation being alternately carried out, and changeover from the first step to the second step being controlled such that a bottom end of said traverse tube in said pot is at a position defined by $D_2 \geqq L_2$ wherein $D_2$ represents an innermost diameter of said yarn package formed in said pot by said first step operation while $L_2$ represents a distance between said bottom end of said traverse tube and an upper terminal of an aperture formed from a bottom inside surface of said pot.

2. A method for doubling and twisting a material yarn by a two-step changeover system by means of a pot winding and twisting device according to claim 1, further comprising measuring a physical condition of said doubled and twisted yarn delivered from said aperture of said pot during said second step operation, and cutting the single yarn which follows said doubled and twisted yarn upon detecting sudden change of said physical condition of said doubled and twisted yarn.

3. A method for doubling and twisting a material yarn by a two-step changeover system by means of a pot winding and twisting device according to claim 1, further comprising continuously counting the length of said material yarn supplied into said pot, during said first step operation, and upon detecting that a predetermined length of said material yarn has been supplied into said pot by said counting operation, positioning said traverse tube at a position where said condition $D_2 \geqq L_2$ can be satisfied and, hereafter, starting said second step operation.

4. A method for doubling and twisting a material yarn by a two-step changeover system by means of a pot winding and twisting device according to claim 2, wherein said measuring of the physical condition of said doubled and twisted yarn is carried out by measuring the yarn tension thereof.

5. A method for doubling and twisting a material yarn by a two-step changeover system by means of a pot winding and twisting device according to claim 2, wherein said measuring of the physical condition of said doubled and twisted yarn is carried out by measuring the variation of thickness of said yarn delivered from said pot.

6. A method for doubling and twisting a material yarn by two-step changeover system by means of a pot winding and twisting device according to claim 1, further comprising measuring the yarn tension of a material yarn at a yarn passage upstream of said pot, and upon detecting an abnormal decrease of said yarn tension, said material yarn is cut at a position upstream of the point of measuring said yarn tension so that supply of said material yarn to said pot is stopped.

7. A method for doubling and twisting a material yarn by a two-step changeover system by means of a pot winding and twisting device according to claim 6, further comprising stopping all driving elements of said pot device and related mechanisms upon detecting an abnormal decrese of said yarn tension.

8. A method for doubling and twisting a material yarn by a two-step changeover system by means of a pot winding and twisting device according to claim 1, further comprising changing the ratio between the yarn speed for supplying said material yarn into said pot and the yarn speed for delivering said double and twisted yarn from said pot in accordance with a predetermined program corresponding to a condition of increasing diameter of the innermost yarn layer of said yarn package formed on said inside cylindrical wall of said pot, during said second step operation.

9. An apparatus for doubling and twisting a material yarn by a two-step changeover system comprising a pot twisting and winding device provided with a traverse tube disposed therein in a condition capable of traversing upwardly and downwardly along an axial center thereof, said pot being provided with an aperture formed from a bottom inside surface thereof, a mechanism for feeding a material yarn into said pot by way of said traverse tube, a mechanism for taking up a doubled and twisted yarn composed of said material yarn and a yarn unwound from a yarn package of primary twised yarn, formed on an inside cylindrical wall by a first step operation, from said operature of said pot during a second step operation, means for traversing said traverse tube along said axial center of said pot during said first step operation, and means for controlling the position of a bottom end of said traverse tube during said second step operation in a condition satisfying a relation $D_2 \geqq L_2$, where $D_2$ represents an innermost diameter of said yarn package formed in said pot by said first step operation, and $L_2$ represents a distance between said bottom end of said transverse tube and an upper terminal of said aperture.

10. An apparatus for doubling and twisting a material yarn by a two-step changeover system according to claim 9, wherein said pot is provided with an inside cylindrical space extending along said central axis thereof, the shape of said cylindrical space being defined as $D_1 \leqq L_1$ where $D_1$ represents a diameter of said cylindrical space whle $L_1$ represents an axial length thereof.

11. An apparatus for doubling and twisting a material yarn by a two-step changeover system according to claim 9, wherein said traversing means comprises a vertical sliding shaft displaceably supported by a supporting means in parallel condition to said traverse tube, a connecting arm rigidly connecting said sliding shaft and said traverse tube, a heart shaped cam mechanism for creating reciprocal upward and downward motion of said sliding shaft, a driving mechanism for driving said heart shaped cam mechanism only during said first step operation and an electromechanical means for selectively connecting said driving mechanism to said heart shaped cam mechanism.

12. An apparatus for doubling and twisting a material yarn by a two-step changeover system according to claim 11, wherein said controlling means involves means for detecting when said bottom end of said traverse tube is in a position satisfying said relation $D_2 \geqq L_2$, said detecting means being capable of issuing a signal to actuate said electro-mechanical connecting means so as to disengage said driving mechanism from said heart shaped cam mechanism when said bottom end of said transverse tube is displaced to a position defined by $D_2 \geqq L_2$.

13. An apparatus for doubling and twisting a material yarn by a two-step changeover system according to claim 9, further comprising a device for detecting a physical condition of said doubled and twisted yarn disposed along a yarn passage at a position downstream to said pot, and a cutting mechanism for cutting a single yarn which follows said doubled and twisted yarn which is capable of actuation by an electric signal issued from said measuring device when a sudden change of physical condition of yarn is detected.

14. An apparatus for doubling and twisting a material yarn by a two-step changeover system according to claim 13, wherein said measuring means actuates means for stopping rotation of the pot when an abnormal physical condition of yarn is detected.

15. An apparatus for doubling and twisting a material yarn by a two-step changeover system according to claim 13, wherein said measuring means is a device for measuring a yarn tension.

16. An apparatus for doubling and twisting a material yarn by a two-step changeover system according to claim 13, wherein said measuring means is a device for measuring a variation in thickness of yarn.

17. An apparatus for doubling and twisting a material yarn by a two-step changeover system according to claim 9, further comprising a device for measuring a yarn tension of said material yarn disposed along a yarn passage at a position upstream of said pot, and a cutting mechanism for cutting said material yarn disposed along a yarn passage upsteeam of said measuring device, said cutting mechanism being actuated by an electrical signal issued from said measuring device when an abnormal condition of yarn tension is detected.

18. An apparatus for doubling and twisting a material yarn by a two-step changeover system according to claim 9, wherein said feeding mechanism and said take-up mechanism are driven by a common driving source, and further comprising means to adjust the speed ratio between said feeding mechanism and said take-up mechanism at a pitch of less than 0.5%.

19. An apparatus for doubling and twisting a material yarn by a two-step changeover system according to claim 9, wherein said feeding mechanism comprises a feed roller having a cone shape which is positively driven, at least one nip roller having a cone shape always pressed against said feed roller, a yarn guide means disposed along a yarn passage directed to a said feeding mechanism, means for gradually displacing said yarn guide means along an axial direction of said feed roller in accordance with the decreasing size of the yarn package formed in said pot during said second step operation.

20. An apparatus for doubling and twisting a material yarn by a two-step changeover system according to claim 9, wherein said feeding mechanism comprises at least one feed roller, having stepwisely expanded diameter shape, which is positively driven, at least one nip roller having a shape corresponding to said feed roller in such a condition that each stepped portion of said feed roller is capable of contacting a corresponding stepwise portion of said nip roller, a yarn guide means disposed along a yarn passage directed to said feeding mechanism of feed and nip rollers, and means for gradually displacing said yarn guide means along an axial direction of said feed roller in accordance with the decreasing size of the yarn package formed in said pot during said second step operation.

21. A method for doubling and twisting a material yarn by a two-step changeover system by means of a pot twisting and winding device according to claim 1, including feeding the material yarn by a feed mechanism comprising at least one feed roller and at least one nip roller, and nipping the yarn material by these rollers at least twice and passing the yarn material around the nip roller with an angle of contact of at least 90°, and delivering the doubled and twisted yarn by a delivery mechanism comprising at least one non-nip roller and free rotating roller.

* * * * *